United States Patent [19]

Giulie

[11] 3,970,331

[45] July 20, 1976

[54] BINDER ELEMENT

[75] Inventor: Joe D. Giulie, Los Altos Hills, Calif.

[73] Assignee: Minnesota Mining and Manufacturing Company, St. Paul, Minn.

[22] Filed: May 12, 1975

[21] Appl. No.: 576,787

Related U.S. Application Data

[63] Continuation-in-part of Ser. No. 388,246, Aug. 13, 1973, abandoned.

[52] U.S. Cl. ..... 281/21 R; 281/25 R; 402/63; 402/68

[51] Int. Cl.[2] ..... B42D 1/00

[58] Field of Search ..... 281/25 R, 21 R; 402/60, 402/61, 63, 68, 69, 2, 22, 52; 85/7, 5 M; 24/67.1, 67 R, 153 S

[56] References Cited

UNITED STATES PATENTS

| | | | |
|---|---|---|---|
| 330,266 | 11/1885 | Shehan | 85/5 M X |
| 1,040,506 | 10/1912 | Byron | 402/22 |
| 1,845,671 | 2/1932 | Lotter | 281/25 R |
| 2,109,520 | 3/1938 | Awbrey | 85/7 X |
| 2,894,426 | 11/1959 | Rapata | 85/7 X |
| 3,260,264 | 7/1966 | McKowen | 402/22 |
| 3,340,635 | 9/1967 | McIntosh | 402/63 X |
| 3,533,511 | 10/1970 | Giampa | 402/68 X |
| 3,596,929 | 8/1971 | Abildgaard et al. | 402/63 X |

FOREIGN PATENTS OR APPLICATIONS

| | | | |
|---|---|---|---|
| 950,768 | 2/1964 | United Kingdom | 402/63 |
| 16,433 | 8/1908 | United Kingdom | 402/63 |

*Primary Examiner*—Jerome Schnall
*Attorney, Agent, or Firm*—Alexander, Sell, Steldt & DeLaHunt

[57] ABSTRACT

A binder element for books and the like is provided wherein a first backing strip having a series of studs thereon, which are provided with ratchet teeth, is used in conjunction with a second backing strip for the opposite side, wherein the second strip has a series of holes each with a mating ratchet tooth for engagement with the teeth on the studs. A blocking means is provided to hold the ratchet teeth permanently in engagement with each other. After the binding has been applied, any excess length of the studs can be broken or cut off.

10 Claims, 14 Drawing Figures

BINDER ELEMENT

RELATED APPLICATIONS

This application is a continuation-in-part of application Ser. No. 388,246, filed Aug. 13, 1973, now abandoned.

SUMMARY OF THE INVENTION

The present invention relates to binding elements for books and the like which can be used to bind a sheaf of papers together into a book. The binding elements of the present invention can be easily applied to sheaves of paper of different thicknesses and can be applied with very simple equipment or can even by applied without the use of mechanical equipment of any kind.

A need exists in libraries and other institutions for replacing the bindings on books or providing permanent bindings on magazines or the like, which are ordinarily of a temporary nature, and which would be destroyed through normal use. In the past it has been necessary for libraries to send out such books or publications for the application of permanent bindings, but the device of the present invention allows the library to bind its own materials. Thus the material is out of circulation for only a relatively short time, and the expense of the usual binding operation is greatly reduced.

In many industries a similar need exists for binding together price lists, catalog sheets, instruction booklets and the like.

Various proposals have been made in the past for such easily applied bindings, but they have not been fully successful, mostly due to the fact that they require relatively expensive machinery for clamping the binding elements together and frequently require the application of heat and mechanical pressure. Although the binding elements of the present invention can be advantageously assembled using simple machinery, they can also be merely pressed together by hand tools.

Preferably, the binding elements of the present invention are made of relatively inexpensive plastic so that they can be injection molded in large quantities at low cost.

Various features and advantages of the present invention will be brought out in the balance of the specification.

DESCRIPTION OF THE PREFERRED EMBODIMENTS

Figure 1:
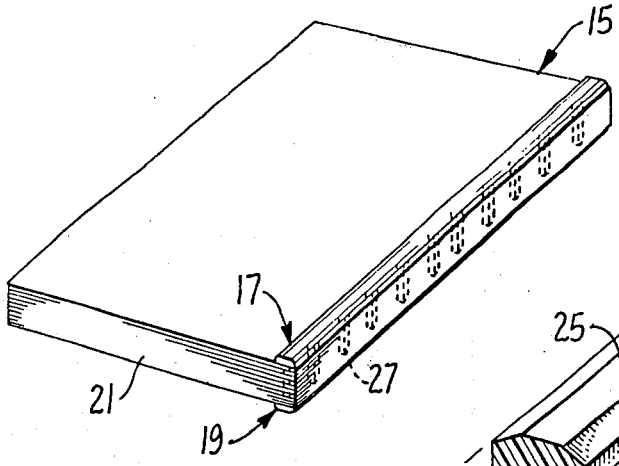
FIG. 1 is a perspective view of a book bound in accordance with the present invention.
Figure 2:
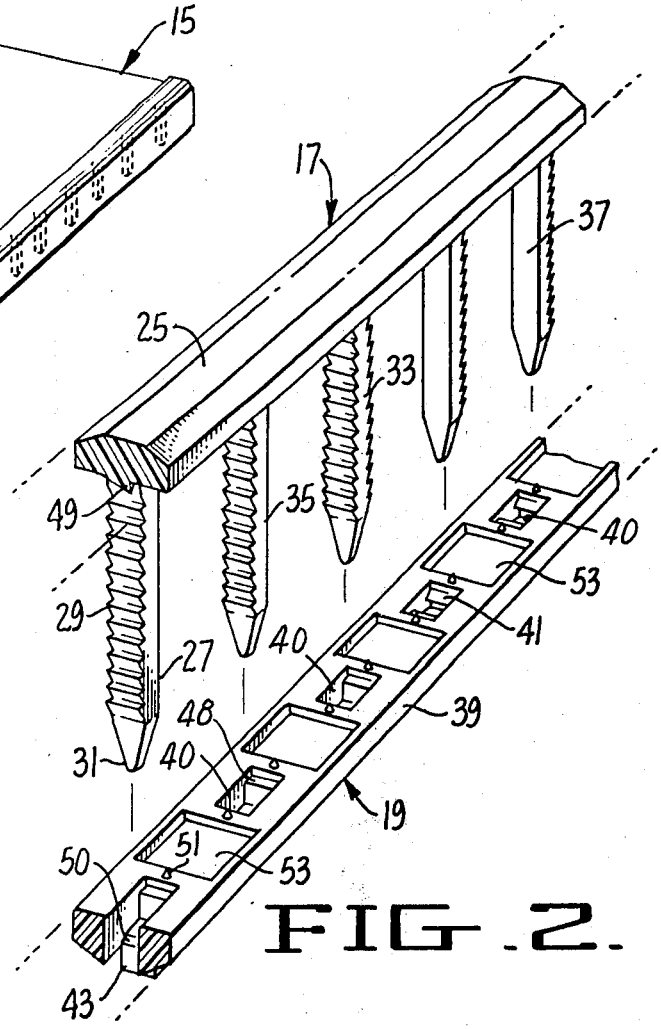
FIG. 2 is an enlarged, exploded, perspective view of a binder element embodying the present invention.

Referring now to the drawings by reference characters there is shown a book generally designated 15 which is held in assembled relationship by means of an upper binding strip or element 17, and a lower binding or backing strip 19. The terms "upper" and "lower" are used only for convenience, since it is obvious that either side could be considered the top. The book 15 includes a plurality of sheets 21 of paper or the like, having a series of slots or holes 23 therein at appropriate intervals, as will later be apparent.

The upper binding element 17 includes a strip 25, having a series of studs 27, rectangular in cross-section, extending therefrom. Each of the studs 27 has a plurality of ratchet teeth 29 positioned in an array along a major portion of the length of the stud, i.e. along substantially the entire length of the stud. The end of the stud is preferably pointed as at 31 for ease of insertion of the stud through the sheaf of papers and the mating lower binding element and ratchet teeth are not formed on the tapered portion.

Figure 6:
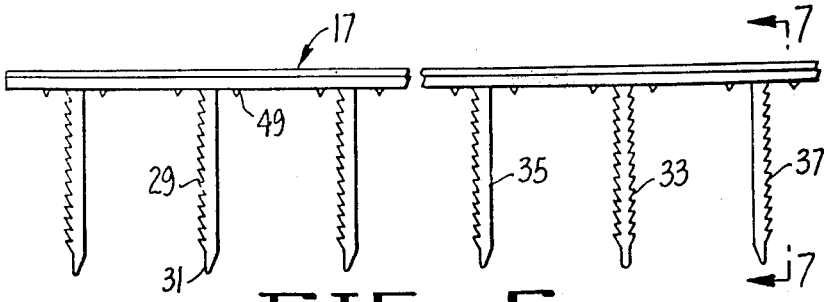
FIG. 6 is a side view of the upper binding strip of the binder element having studs.
Figure 7:
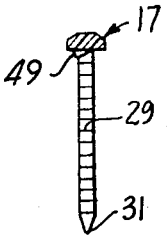
FIG. 7 is a section on line 7—7 of FIG. 6.
Figure 8:
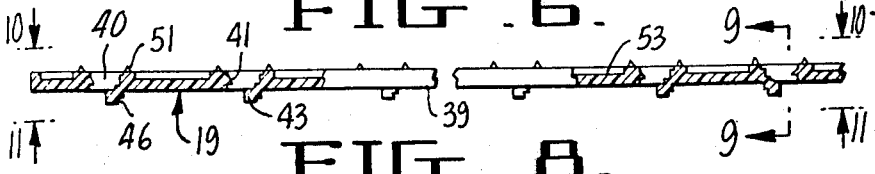
FIG. 8 is a section of the lower binding strip of the binder element having a series of holes.
Figure 9:
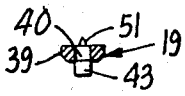
FIG. 9 is a section on the line 9—9 of FIG. 8.
Figure 10:
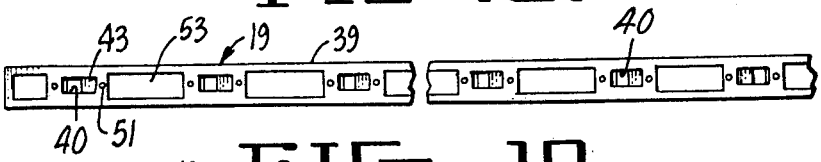
FIG. 10 is a plan view of the lower binding strip taken on the line 10—10 of FIG. 8.
Figure 11:
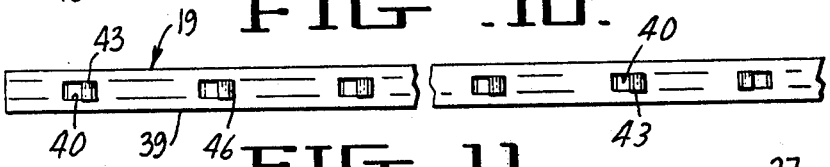
FIG. 11 is a bottom plan view of the lower binding strip of FIG. 8 taken on the line 11—11.

The ratchet teeth 29 are located on either side of the stud transverse to the length of the element or, in a preferred embodiment of the invention, an odd number of studs is employed and the center stud has ratchet teeth on both sides thereof, as is shown at 33. With an odd number of studs, the ratchet teeth on each side of the central stud will point in opposite directions. This is most apparent in FIG. 6, wherein the center stud is designated 33 while the studs to the left, as at 35, have the ratchet teeth pointing to the left while those on the opposite side designated 37 have the ratchet teeth pointing to the right. If an even number of studs is employed, it is not necessary for any stud to have ratchet teeth on both sides. Also, it will be apparent that the reason for having the ratchet teeth on each side of center, whether the total number of studs be odd or even, point in opposite directions is that the user can install the upper binding element 17 in either direction, while if all of the ratchet teeth point in the same direction, it will be necessary that the upper binding element be installed in only a proper orientation.

Each lower binding element consists of a strip 39 having a series of mating apertures 40 corresponding in placement to the studs on the upper binding element and having substantially the same length and width as the upper binding element. Each of the apertures 40 has a size larger than the cross-section of a complementary stud to freely receive the stud and is formed with at least one ratchet tooth 41, on a wall thereof, projecting into the opening and having the riser or step that is perpendicular to the wall disposed in the opening between the opposite faces of the strip and positioned to mate with the teeth on the studs. Although a single tooth has been found fully operative for the purposes of the present invention, two or more teeth can be employed. Each aperture 40 has one wall thereof formed with a shoulder 47 defined by an undercut as at 48.

Figure 4:
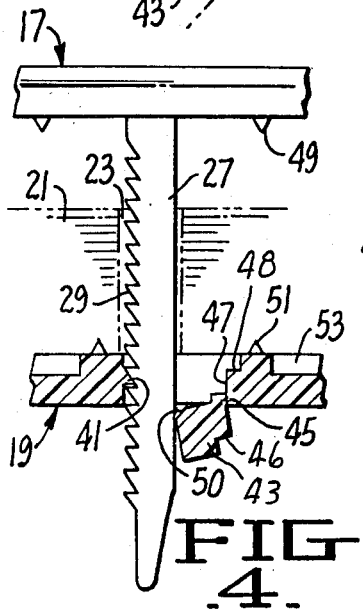
FIG. 4 is a view similar to FIG. 3, showing the next stage of applying the binder element.

Adjacent to the aperture, and overlapping the aperture somewhat, is a block 43 which is formed integrally with the lower binding strip but which is connected thereto only by a thin web 45 of the material from which the strip is formed. The clear aperture of the opening 40 with block 43 in place, is such that the stud can barely pass through the hole and will possibly push the block 43 slightly to one side, as is shown in FIG. 4. Preferably block 43 is tapered opposite the web 45 as is shown at 50 to minimize tipping of the block 43 so it can be driven straight into the opening 40. The block 43 is also provided with a recess 46 and the clearances are such that when block 43 is detached and forced into the aperture 40 the ratchet teeth will be fully engaged, preventing further movement.

Preferably one or both of the strips have a series of inwardly directed points which help engage and hold the papers in fixed relationship. Thus, the upper binding element 17 may have a series of downwardly directed points 49, while the lower binding element 19 has a series of upwardly directed points 51. In order to conserve plastic and lighten the structure without unduly weakening it and making the unit more flexible, one or both of the strips may have relieved sections in the face between the studs or holes such as those sections designated 53. These would not normally extend completely through the strip in order to preserve the smooth outline of the outer surface as well as to contribute strength to the structure. Thus, if the strip flexes, it will bend between the fastening elements and the fastening elements themselves will be rigid.

Figure 3:
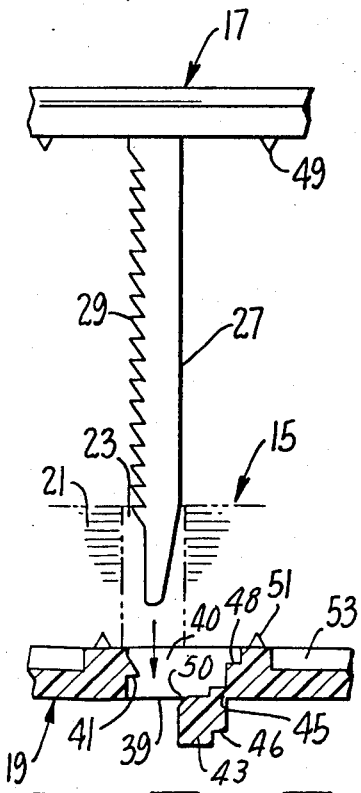
FIG. 3 is a side view showing in diagrammatic form the first stage of applying the binder element embodying the present invention.
Figure 5:
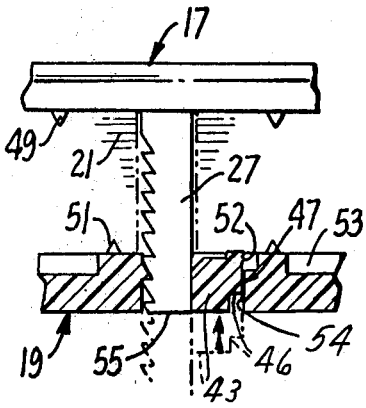
FIG. 5 is a view similar to FIG. 3, showing the final stage of applying the binder element.

The manner of assembling the binder element can be seen from FIGS. 3, 4 and 5. In FIG. 3 a stack of paper 21 has been provided which has a series of holes or slots 23 therein, and the lower binding element 19 is placed under the stack with the aperture 40 directly under the opening 23. The upper binding element 17 is now placed over the stack of papers, and the studs 27 pushed into the holes 23. As is shown in FIG. 4, as the stud encounters the block 43, it will be pushed aside slightly, bringing the ratchet teeth 29 into contact with the single ratchet tooth 41, but web 45 has sufficient flexibility for the block to spring back, allowing the ratchet teeth to clear each other. When the strips come in contact with the stack of paper 21, they are preferably pushed together under a substantial pressure to secure a tight bundle. Now one presses inwardly on the block 43, rupturing the web 45 which was holding the block in place, and permitting the block 43 to be pushed upward to be flush with the outer surface of strip 19 and into the hole and against the stud 27 and shoulder 47, holding the mating ratchet teeth firmly in engagement. In this embodiment of the invention, block 43 does not turn and it is pushed directly inward, as is shown by the rupture lines and any fragment of the hinge will fall into the undercut 48 as is shown at 52 and into the recess 46 as shown at 54. It will now be seen that the parts are locked firmly in place and that the ratchet teeth are held together in a positive relationship so that there is no chance of slippage. The end of the stud 27 can now be cut off flush with the strip, as is shown at 55, to yield the finished permanently bound volume. The locking step of tooth 41 is preferably positioned in the opening 40 in spaced position from the outer exposed surface of the binding element 19 by one and one half times the pitch of the teeth on the stud to allow room for at least one and a half teeth of the stud 27 in the hole after it is cut flush as shown most clearly in FIG. 5.

Figure 12:
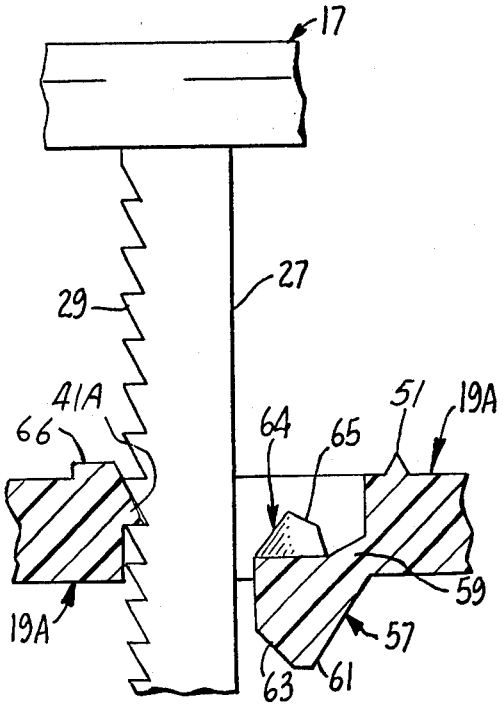
FIG. 12 is an enlarged sectional view of another embodiment of the invention.
Figure 14:
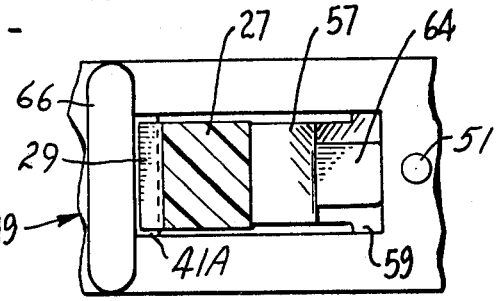
FIG. 14 is a partial plan view on the line 14—14 of FIG. 13.
Figure 13:
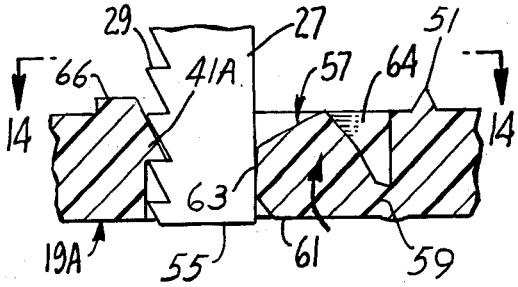
FIG. 13 is a partial view, similar to FIG. 12, showing the parts in the locked position.

In FIGS. 12 through 14, another embodiment of the invention is shown wherein the block is not ruptured from the strip but is merely turned upon itself within the aperture between the faces of the strip 19A to lock the ratchet teeth together. This construction is particularly advantageous when using a somewhat soft plastic such as polyethylene or polypropylene, which will bend a very substantial distance without breaking. The upper strip 17 having studs 27 and ratchet teeth 29 is exactly the same as previously described. The lower strip 19A is provided with a ratchettooth 41A, as before, but the locking block is substantially modified. The block, generally designated 57, is connected to the strip 19A by means of a thin web or hinge section 59. The block 57 has a flat portion 61 extending at an angle of about 135° from the back of the strip and has an angling portion 63, extending therefrom at an angle of about 90° to side 61. The block 57 includes a center portion 64 having a surface 65 which is parallel to side 63 the distances between the surfaces 63 ratchet tooth 65 being such that, when the block is turned, as is shown in FIG. 13, the teeth 29 and 41A will be locked firmly together. With this embodiment of the invention, the block is merely rotated into place when the strips have been squeezed together to the desired degree. As before, stud 27 is cut off flush with the back or outer exposed surface of the strip 19A. The locking step of tooth 41A is spaced from the exposed surface of the stud 19A by at least one and one half times the pitch of the teeth on the stud 27 to leave at least one and one half teeth on the stud 27 between the tooth and said exposed surface after the stud is cut flush. This is illustrated in FIGS. 12, 13 and 14. Also, a rib 66 may be positioned across the inner surface of the binding element to strengthen the tooth in the binding element 19 or 19A.

Many variations can be made in the exact structure shown without departing from the spirit of this invention. For instance, the studs have been shown as substantially square in cross-section, but they might be rectangular. Preferably the strips are formed from a hard plastic which can be cast by injection molding such as a vinyl, acrylic or ABS resin. Obviously, many other polymeric materials are suitable for this purpose. If desired, relatively soft plastic may be used, such as polyethylene, to give some flexibility to the finished structure.

What is claimed is:

1. A binder element for an apertured book or the like, comprising in combination:

a. a first strip having a plurality of spaced studs extending therefrom, said studs having a plurality of ratchet teeth on at least one edge thereof, b. a second mating strip having substantially the same length and width as said first strip with complementary spaced openings extending therethrough and having a size larger than the cross-section of the complementary stud to freely receive said stud, each of said openings being defined by a wall having at least one ratchet tooth thereon extending into said opening and adapted to engage in said opening the ratchet teeth on the complementary stud extending from the first strip, and c. locking means adapted to move into said openings, said locking means consisting of a series of blocks each held by a thin web to said second mating strip along an edge of each of said openings, said blocks being located to be forced directly into said openings for holding said ratchet teeth of the two strips in engagement with each other.

2. A binder element according to claim 1 wherein said thin web can be fractured and said block forced into said opening.

3. A binder element according to claim 1 wherein said thin web is flexible and said block is adapted to rotate into said opening for holding the ratchet teeth in engagement with each other.

4. A binder element according to claim 1 wherein the studs on the first strip have ratchet teeth facing in one direction on one side of the center of the strip and have teeth facing in the opposite direction on the other side of said center.

5. A binder element according to claim 4 wherein an odd number of studs is employed and wherein the center stud has ratchet teeth on both sides thereof.

6. A binder element according to claim 4 wherein said thin web is flexible and each block is adapted to frictionally fit into said opening with said stud and hold the ratchet teeth in engagement with each other.

7. A binder element according to claim 1 wherein each opening in said second strip has a shoulder formed by an undercut in the wall of the opening opposite the ratchet tooth, and each block is adapted upon rupture of said thin web to fit firmly into the opening with the stud to afford engagement of the ratchet tooth extending into said opening in engagement with a tooth on said stud and to maintain the teeth in engagement and to afford engagement of said shoulder with a portion of the ruptured web disposed in said undercut.

8. A binder element according to claim 1 wherein each block is tapered on an edge opposite the web to reduce binding as the block is forced into the opening after insertion of the stud to firmly hold the ratchet tooth extending into the opening in engagement with the stud.

9. A binder element according to claim 1 wherein said studs each have a plurality of ratchet teeth positioned in an array along a major portion of the entire length of said studs.

10. A binder element according to claim 1 wherein the locking step of said ratchet teeth in said openings of said second mating strip are spaced from the exposed surface of said second strip by an amount equivalent to at least one and one half times the pitch of the teeth on the studs.

* * * * *

UNITED STATES PATENT AND TRADEMARK OFFICE

CERTIFICATE OF CORRECTION

PATENT NO. : 3,970,331

DATED : July 20, 1976

INVENTOR(S) : Joe D. Giulie

It is certified that error appears in the above-identified patent and that said Letters Patent are hereby corrected as shown below:

Column 1, line 15, "by" should be -- be --.

Column 4, line 13, "ratchettooth" should be -- ratchet tooth --.

Column 4, line 22, "ratchet tooth " should be -- and --.

Signed and Sealed this

First Day of February 1977

[SEAL]

*Attest:*

RUTH C. MASON
*Attesting Officer*

C. MARSHALL DANN
*Commissioner of Patents and Trademarks*